US007188502B2

(12) United States Patent
Heimann

(10) Patent No.: US 7,188,502 B2
(45) Date of Patent: Mar. 13, 2007

(54) METHOD AND DEVICE FOR CHANGING THE ROLLS OF A TUBE WELDING STAND

(75) Inventor: Bernhard Heimann, Moers (DE)

(73) Assignee: SMS Meer GmbH, Monchengladbach (DE)

( * ) Notice: Subject to any disclaimer, the term of this patent is extended or adjusted under 35 U.S.C. 154(b) by 251 days.

(21) Appl. No.: 10/498,275

(22) PCT Filed: Dec. 3, 2002

(86) PCT No.: PCT/EP02/13635

§ 371 (c)(1),
(2), (4) Date: Jun. 3, 2004

(87) PCT Pub. No.: WO03/047783

PCT Pub. Date: Jun. 12, 2003

(65) Prior Publication Data

US 2005/0006351 A1 Jan. 13, 2005

(30) Foreign Application Priority Data

Dec. 6, 2001 (DE) ..... 101 60 004

(51) Int. Cl.
*B21B 31/07* (2006.01)
*B21D 5/08* (2006.01)
*B21D 39/00* (2006.01)

(52) U.S. Cl. ..... 72/239; 72/181; 228/147

(58) Field of Classification Search ..... None
See application file for complete search history.

(56) References Cited

U.S. PATENT DOCUMENTS 2,012,795 A * 8/1935 Park ..... 72/113
3,006,224 A * 10/1961 Celovsky ..... 72/234
3,217,526 A * 11/1965 Wilson et al. ..... 72/239
4,122,696 A * 10/1978 Midzutani et al. ..... 72/52
4,709,845 A 12/1987 Akiyama et al.
4,979,555 A * 12/1990 Helberger et al. ..... 164/442
5,016,806 A * 5/1991 Yapp et al. ..... 228/147
5,301,869 A * 4/1994 Toyooka et al. ..... 228/147
5,823,036 A * 10/1998 Matsunaga ..... 72/181
6,167,738 B1 * 1/2001 Horold et al. ..... 72/239

FOREIGN PATENT DOCUMENTS

| | | |
|---|---|---|
| DE | 1 602 315 | 5/1970 |
| DE | 34 23 706 | 9/1985 |
| JP | 59199113 | 11/1984 |

* cited by examiner

*Primary Examiner*—Lynne R. Edmondson
(74) *Attorney, Agent, or Firm*—Andrew Wilford

(57) ABSTRACT

The invention relates to a method for changing sets of top rolls, lateral rolls, and a bottom roll, and mounted in chocks of a welding stand of a continuously operating longitudinal tube welding machine. The inventive method enables the rolls to be changed faster, using less appliances. Said method comprises the following steps: the top rolls are lifted; a dismantling/transport means is placed beneath the top rolls; the top rolls are lowered onto the dismantling/transport means and deposited on the same; and, once the top rolls have been removed, the dismantling/transport means is laterally withdrawn.

5 Claims, 6 Drawing Sheets

METHOD AND DEVICE FOR CHANGING THE ROLLS OF A TUBE WELDING STAND

CROSS REFERENCE TO RELATED APPLICATIONS

This application is the US national phase of PCT application PCT/EP02/13635, filed 3 Dec. 2002, published 12 Jun. 2003 as WO 03/047783, and claiming the priority of German patent application 10160004.6 itself filed 6 Dec. 2001.

FIELD OF THE INVENTION

The invention relates to a method of and apparatus for changing a roll set comprised of upper rolls, side rolls, and a lower roll carried in respective supports in a frame of a continuously working longitudinal-seam tube-welding machine.

BACKGROUND OF THE INVENTION

A large portion of tubing of steel and other metals is produced by continuous longitudinal-seam welding. To this end a strip is unwound from a coil, is then shaped by several roll sets into a round slitted tube, and is welded. In order to make the seam, the strip edges are heated to welding temperature and then pressed together by the welder such that they weld together. The rolls of this device must be changed often, either to accommodate a change in tube diameter or in case of wear. It is necessary to change rolls as quickly as possible in order to avoid undesirable down time. Finally, roll change should be executed with the least expensive technical and machine elements as well as minimal manual steps.

Small tube-welding machines have rolls and roll frames of moderate weight so that the assemblies can be changed mainly by hand. Welders for large-diameter tubing, of for example 600 mm diameter and up have rolls that cannot be dealt with manually but require special equipment. In the roll-changing method of German 1,602,315 the rolls are suspended on a cable and shifted by a crane out of the machine. In order to release the rolls from their frames, it is necessary to pull out a central support arbor. The arbor and its connection with the roll are specially made. Changing rolls individually, with the time-consuming hooking up to the crane, takes quite some time.

Another start of the art is known from German 3,423,706 (U.S. equivalent U.S. Pat. No. 4,709,845). In order to speed up changing from one tube size to another there are four roll frames of different dimensions set up as a sort of turntable on the machine bed. When the roll diameter is changed, the turntable is rotated appropriately until the new frame is in position. This type of changeover is really quick, but requires a substantial investment in equipment.

OBJECT OF THE INVENTION

It is an object of the invention to provide a method of and apparatus by means of which it is possible the change rolls easily and quickly while using relatively inexpensive equipment.

SUMMARY OF THE INVENTION

This object is achieved according to the invention by a method that is characterized by the steps of raising the upper rolls, positioning a takeoff conveyor under the raised upper rolls, lowering the upper rolls down onto the takeoff conveyor, setting the side rolls and the lower roll on the takeoff conveyor, and releasing the upper rolls and the laterally moving off the conveyor with the complete set of rolls.

The above-described method steps make possible a rapid and, as a result of the modest investment in equipment, inexpensive switching of all the rolls so that it is possible in particular to make the change for a different tube diameter in short order, and the changeover takes virtually no manual interaction.

In an apparatus for carrying out the method upper rolls held in guides are shiftable by a motor drive, a conveyor is formed as an adapter that engages on one side over an upper-roll carriage carried on a beam and on which it is slidable and on the other side on top of a projecting arm underneath the upper rolls, and the upper-roll carriage with the adapter hanging on it is provided with an actuator outside the welder frame.

Here the upper rolls and their guides are shifted for example by motor-driven spindles into an upper takeoff position. Then the adapter on the upper-roll carriage is shifted laterally by the for example motor/spindle drive far enough into the roll frame that the adapter engaged with its L-section arm under the upper rolls. Once the upper rolls are sitting on the adapter, the adapter is shifted by its drive far enough out of the frame that it is freely accessible laterally outside the frame. The upper rolls can then be exchanged with another set of rolls.

In a further embodiment of the invention for changing the upper rolls along with the side rolls and the lower roll, the side rolls are mounted in side-roll holders that are movable by a motor and the side holders are provided with centering formations for the adapter carrying the upper rolls.

The side rolls with their side-roll holders are spread for example by their motor-driven spindles enough that the centering formations are aligned with the complementary seats of the adapter carrying the upper rolls. Then the lower rolls, which are sitting on a vertically movable table, are raised. This lifts the side-roll holders via the supports of the lower rolls enough that the side-roll holders engage and come to rest against the adapter. The centering formations of the side-roll holders engage in the seats of the adapter and lock these parts together. Then the side rolls are disconnected from their adjusters and the guides are disconnected from the upper rolls. As a result the entire assembly, including the adapter with the upper rolls, the side rolls with their holders, and the lower rolls, are pushed by an actuator laterally out of the frame and are there as a single unit switched with a new set of rolls.

BRIEF DESCRIPTION OF THE DRAWING

Further features and specifics of the invention are seen in the following description of an embodiment of the invention shown by way of example in the drawing. Therein.

SPECIFIC DESCRIPTION

Figure 1:
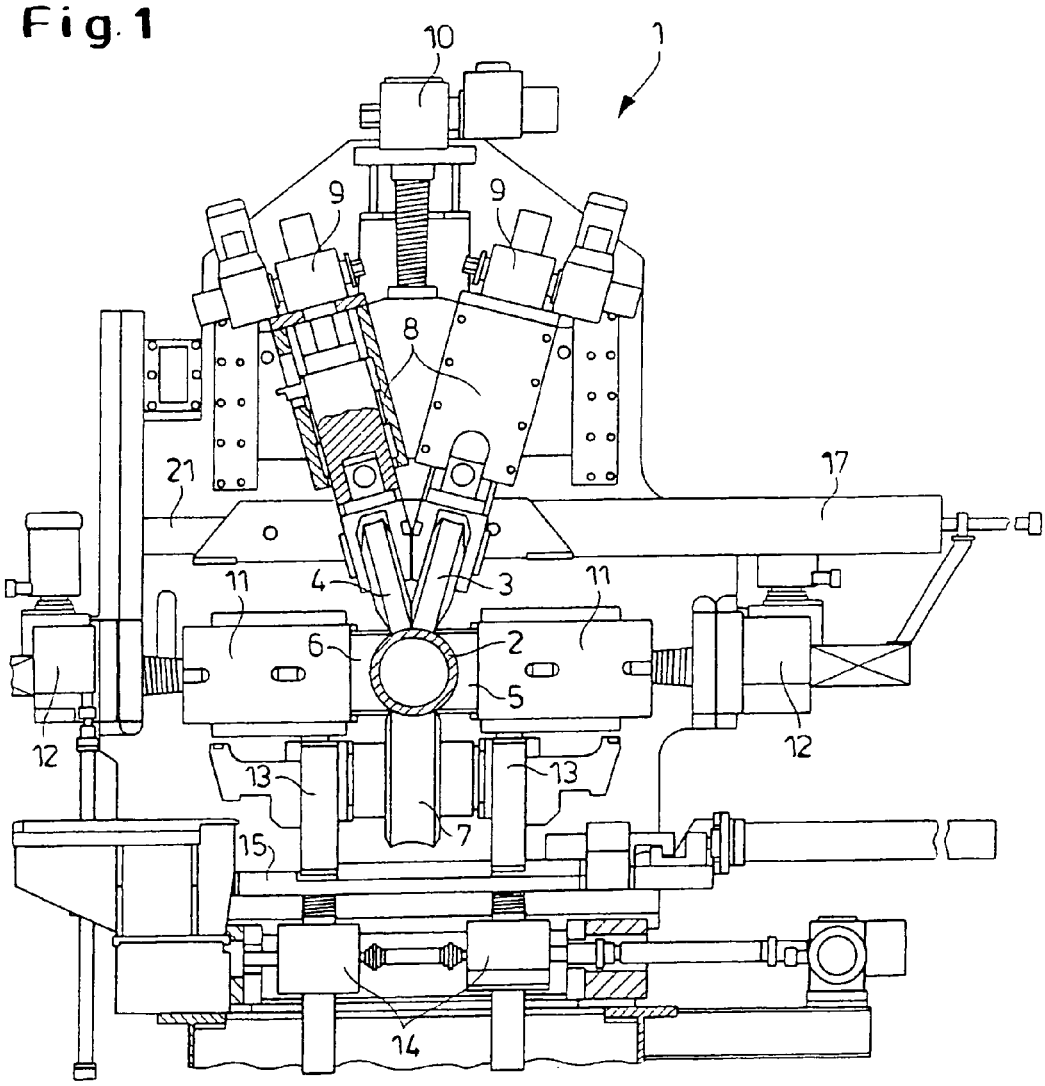
FIG. 1 is an over view of a welder of a tube-welding machine seen in front-end view.

FIG. 1 shows a weld frame 1 of a tube-welding machine lengthwise of a tube 2. The weld frame 1 carries two upper rollers 3 and 4, side rollers 5 and 6, and a lower roll 7. The upper rollers 3 and 4 are carried in guides 8 and are positioned by a drive 9, 10 comprised of a motor-transmission 9 as well as by a spindle device 10. The side rolls 5 and 6 are supported in side-roll holders 11 and are positioned by motor-spindle units 12. The lower roll 7 is mounted in a support 13 sitting on a table 15 carried by a height adjuster 14. The entire set of rolls is shown in FIG. 1 in the working position.

Figures 2, 3:
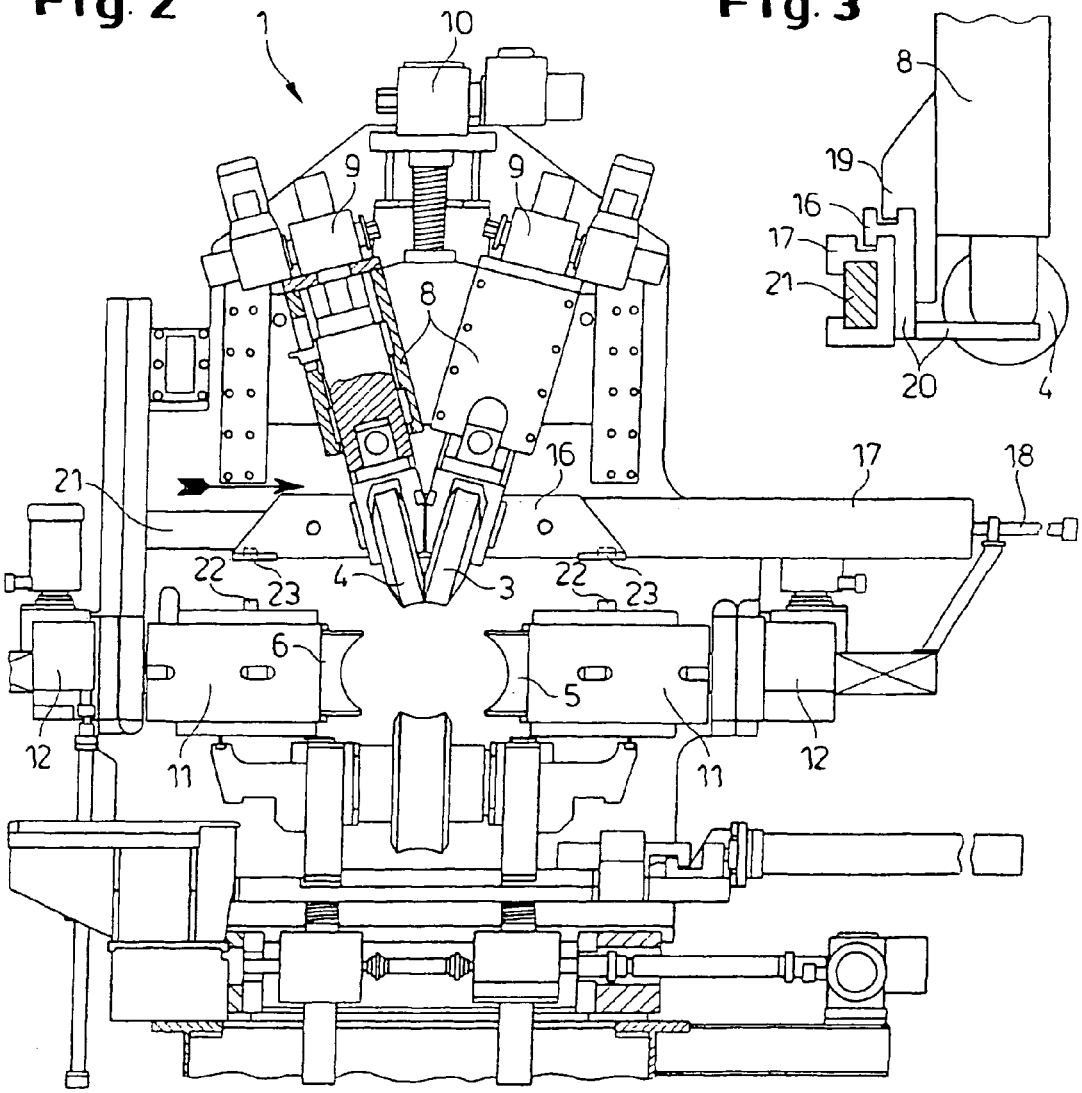
FIGS. 2, 4, 5, and 6 are front views of the welder with the figures showing succeeding steps in the changing of an entire set of rolls.
FIG. 3 is a side partly sectional view of a upper roller of the welder.

In order to dismount the entire set of rolls, in a first step as shown in FIG. 2 the upper rolls 3 and 4 are raised by the motor-driven drive 9, 10 into an upper takeoff position. Then an adapter 16 that is releasably clamped to an upper-roll carriage 17 (see FIG. 3) is shifted by a spindle-type actuator 18 from the side into the illustrated position underneath the upper rolls 3 and 4. Subsequently the upper rolls 3 and 4 and their guides 8 are lowered by means of their motor drive 9, 10 onto the adapter 16, whereupon on one side the upper rollers 3 and 4 engage with a hook bar 19 over the adapter 16 and on the other side their guides 8 engage on a projecting L-section arm 20 that forms another support on the adapter 16. The adapter 16 and the upper-roll carriage 17 are carried on a beam 21 that the upper-roll carriage 17 fits around (see FIG. 3). At the same time the drives 12 move the side rolls 5 and 6 away from each other with their holders 11. On reaching the changeover position, centering pins 22 on the side-roll holders 11 are aligned vertically with complementary centering seats 23 of the adapter 16.

Figure 4:
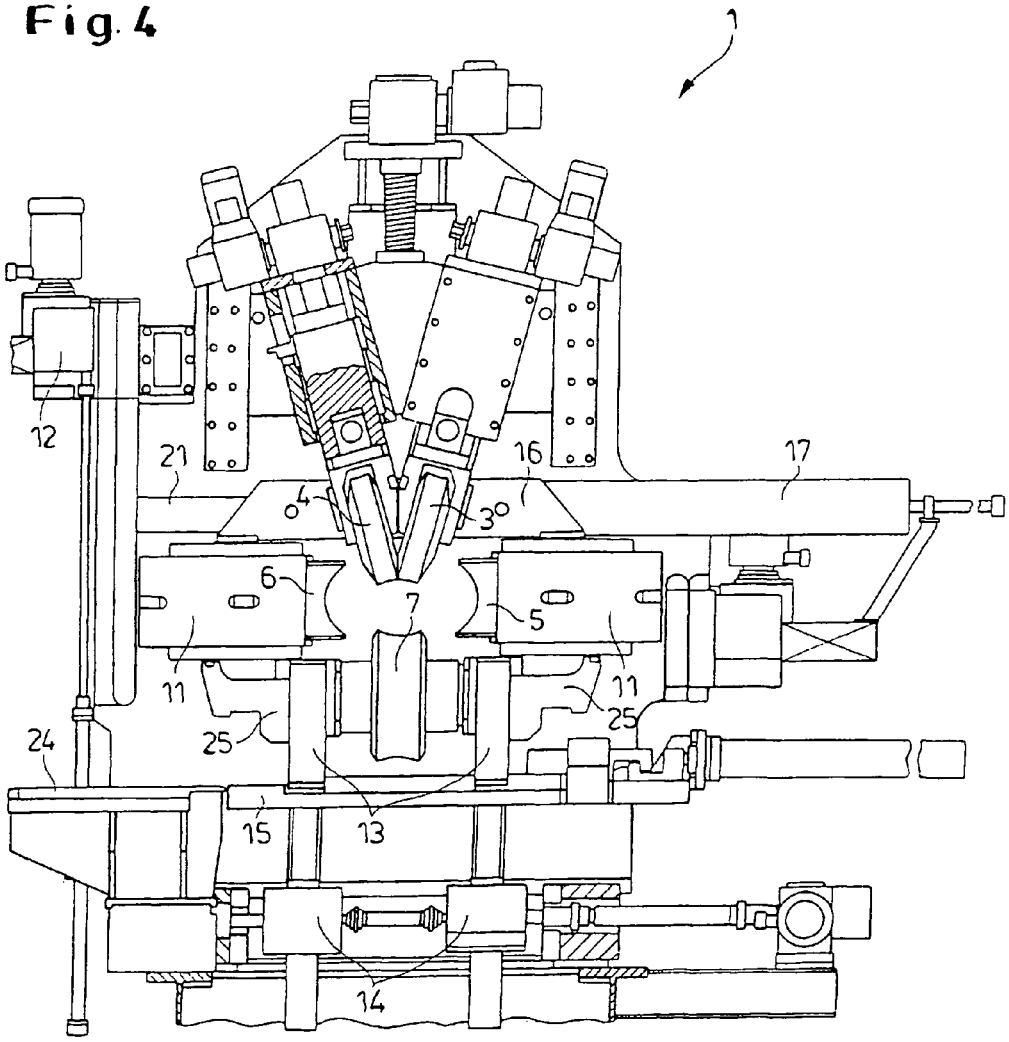

In a further step as shown in FIG. 4, the table 15 with the lower roll 7 is moved by its height adjuster 14 up to the level of a transfer plate 24. In addition and at the same time the side rolls 5 and 6 and their holders 11 are lifted by arms 25 on the supports 13 of the lower roll 7. The side-roll holders 11 are thus pressed up underneath the adapter 16 with the centering pins 22 fitting into the centering seats 23 of the adapter 16.

Figure 5:
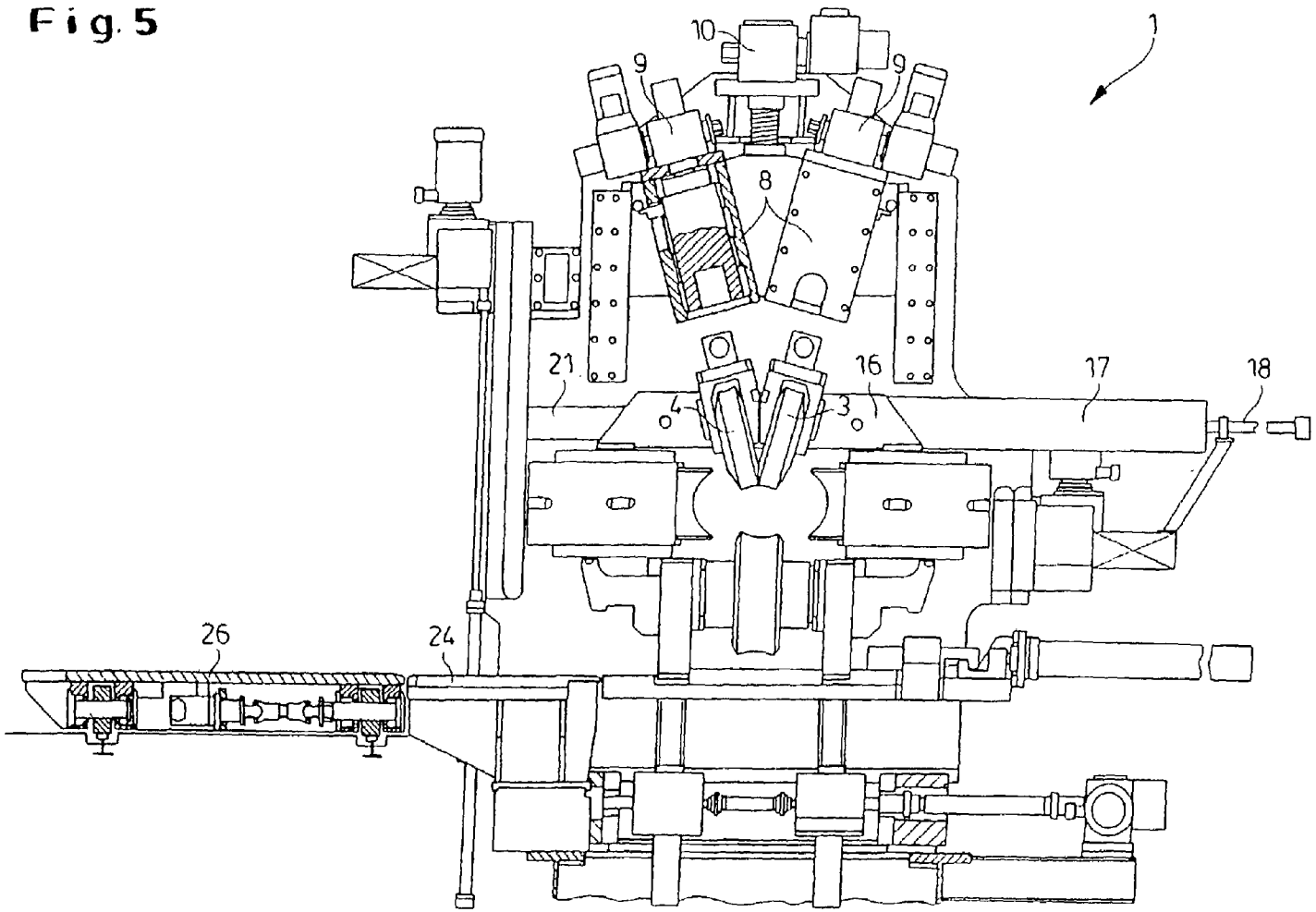

FIG. 5 shows the roll-removing step in which the guides 8 release the upper rolls 3 and 4 and are raised by the drives 9 and 10. The complete set of rolls is thus ready to be shifted laterally out of the frame 1 and slid onto a roll-change carriage 26 that is in a receiving position with its upper surface level with the plate 24, the adapter 16 sliding along on the beam 21. The roll-change carriage 26 can if necessary (not illustrated) carry a new set of rolls so that after taking out the set of used rolls by, for example, shifting it transversely to the frame 1, the new set of rolls can simultaneously be pushed into an install position in the frame and the old set of rolls is shifted into a position where it can be for example picked up by the mill crane and carried off.

Figure 6:
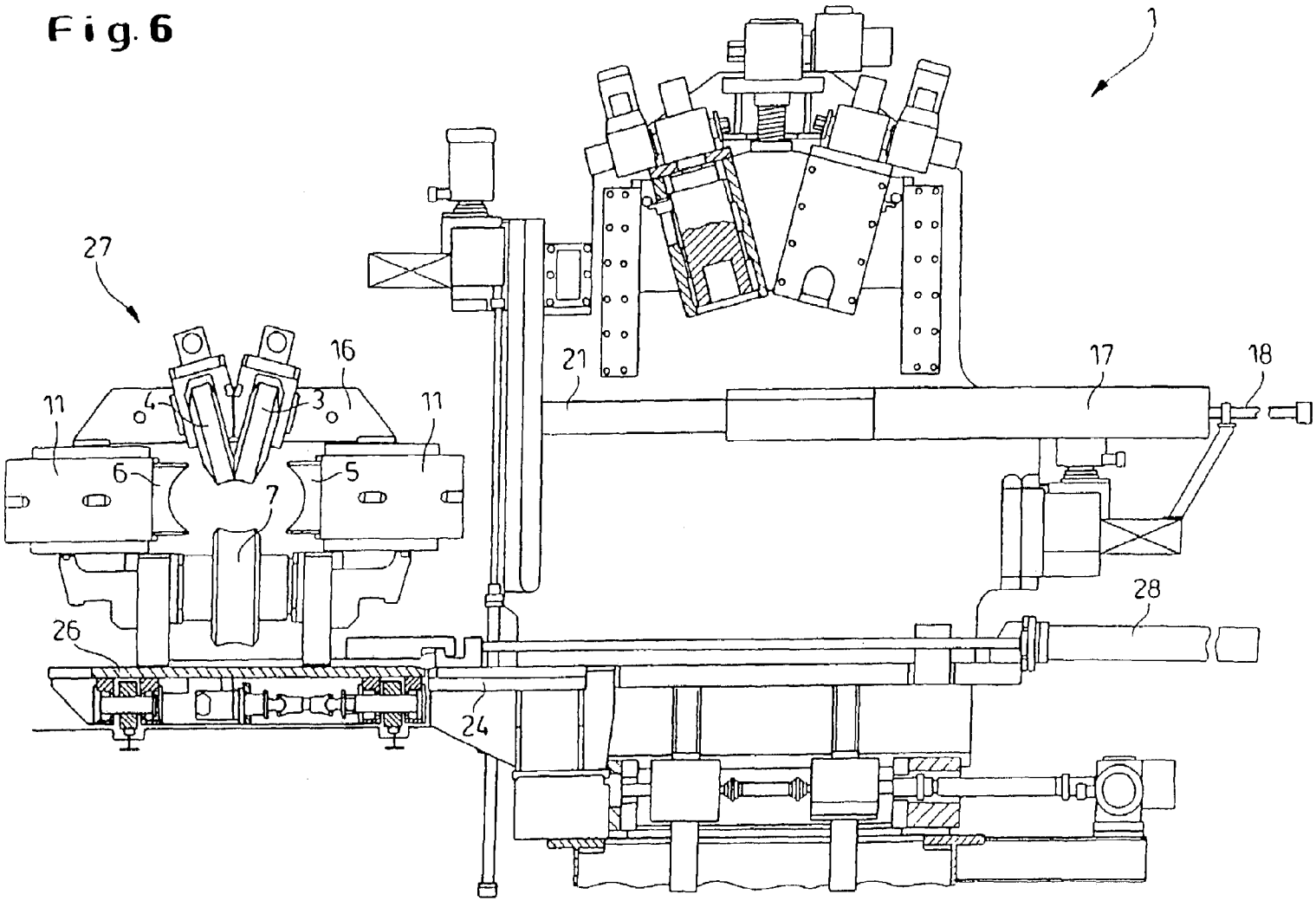

FIG. 6 shows a set 27 of rolls slid by an actuator 28 onto the change carriage 26. As the roll set 27 is being dismounted, the adapter 16 centered between the side-roll holders 11 with the upper rolls 3 and 4 sitting on it is slid off the upper-roll carriage 17 on the support beam 21. The change carriage 26 can now as described above be moved longitudinally parallel to the weld frame and a new set of rolls can be brought into position and mounted in the welder frame 1 by carrying out in reverse order the above-described dismounting steps.

Figure 7:
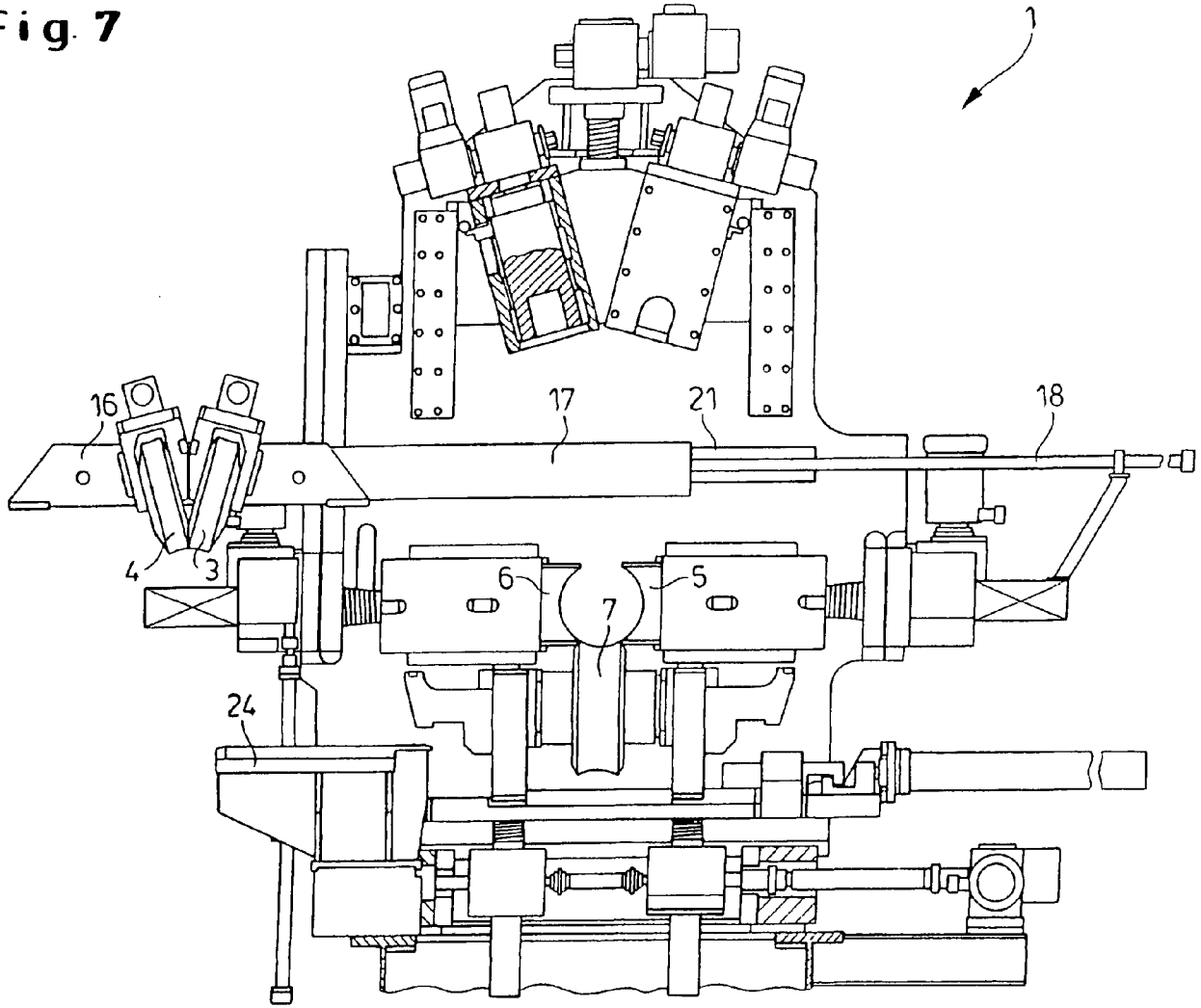
FIG. 7 is a front view of the welder of the tube-welding machine with only the upper roll removed.

Alternately to the above-described dismounting system for the entire set of rolls, FIG. 7 shows a dismounting of only the upper rolls 3 and 4 which wear at a much greater rate than the side rolls 5 and 6 and the lower roll 7. In this case the side rolls 5 and 6 and the lower roll 7 do not need to be raised, rather they stay in the working position. Instead of this, the adapter 16 carrying the upper-roll carriage 17 is moved by the actuator 18 along the beam 21 far enough that the adapter 16 with the upper rolls 3 and 4 sitting on it is shifted into a highly accessible position sticking out of the frame 1. Then the upper rolls 3 and 4 can then simply be exchanged for a new pair of rolls.

The invention claimed is:

1. A method of changing rolls in a tube-welding machine having a frame carrying an upper roll in a holder, a pair of side rolls in respective holders, and a lower roll in a holder, the method comprising the steps of sequentially:

raising the upper roll and its holder from a lower working position to an upper takeoff position;

positioning underneath the raised upper roll and its holder a transfer device including a horizontal guide beam extending through the frame and an adapter slide movable on the beam, the upper roll and its holder being supported wholly on the adapter slide;

lowering the upper roll and its holder onto the transfer device such that the upper roll and its holder are supported on the transfer device;

disconnecting the upper-roll holder from the frame;

laterally transporting the transfer device with the upper roll and its holder out of the frame; and separating the adapter slide from the guide beam after transporting the upper roll and its holder out of the frame.

2. The roll-changing method defined in claim 1 wherein the side-roll holders are shaped to fit with the lower-roll holder and with the adapter slide, the method further comprising the steps of raising the lower roll and its holder such that the lower-roll holder engages underneath and fits with the side-roll holders and thereafter jointly raising the lower roll and its holder with the side rolls and their holders until the side-roll holders fit with the adapter slide, the upper roll and its holder being transported jointly with the side rolls and their holders and the lower roll and its holder out of the frame.

3. A tube-welding machine comprising:

a frame;

an upper-roll holder releasably mounted on the frame;

an upper roll in the upper-roll holder;

a pair of side-roll holders releasably mounted on the frame;

respective side rolls in the side-roll holders generally below the upper roll;

a lower-roll holder releasably mounted on the frame;

a lower roll in the lower-roll holder generally below the side rolls;

a transfer device horizontally displaceable between a pickup position inside the frame and a change position outside the frame, the transfer device including a horizontal guide beam extending through the frame and an adapter slide movable on the beam and separable from the guide beam after being transported with the upper roll and its holder out of the frame;

means for raising the upper roll and its holder from a lower working position to an upper takeoff position, for positioning the transfer device in the pickup position underneath the raised upper roll and its holder, and for lowering the upper roll and its holder onto the transfer device such that the upper roll and its holder are supported on the transfer device;

means for disconnecting the upper-roll holder from the frame; and means for laterally transporting the transfer device with the upper roll and its holder out of the frame into the change position.

4. The tube-welding machine defined in claim 3 wherein the side-roll holders and the adapter slide have vertically interfitting formations, the machine further comprising means for raising the lower roll and its holder such that the lower-roll holder engages underneath and fits with the side-roll holders and thereafter jointly raising the lower roll and its holder with the side rolls and their holders until the side-roll holders fit with the adapter slide, whereby the upper roll and its holder can be transported jointly with the side rolls and their holders and the lower roll and its holder out of the frame.

5. The tube-welding machine defined in claim 4 wherein the formations include a pair of vertically directed pins and a complementary pair of vertically open seats.

* * * * *